United States Patent [19]

Kime

[11] Patent Number: 4,846,346

[45] Date of Patent: Jul. 11, 1989

[54] STORAGE CONTAINER

[76] Inventor: James W. Kime, c/o Creative Industries International, Inc., P.O. Box 767397, Roswell, Ga. 30076

[21] Appl. No.: 261,559

[22] Filed: Oct. 24, 1988

Related U.S. Application Data

[63] Continuation of Ser. No. 115,341, Nov. 2, 1987, abandoned.

[51] Int. Cl.[4] ..... B65D 81/36

[52] U.S. Cl. ..... 206/372; 206/315.11; 206/373; 312/290; 312/DIG. 33

[58] Field of Search ..... 206/541, 545, 349, 315.11, 206/372, 373, 811, 822, 371, 576; D3/73; D9/420, 423, 426; D 7/76; 220/20, 333, DIG. 13; 312/DIG. 33, 283, 290

[56] References Cited

U.S. PATENT DOCUMENTS

| | | | |
|---|---|---|---|
| D. 172,296 | 5/1954 | Nelson | D9/423 |
| D. 226,742 | 4/1973 | Dustin | D3/73 |
| D. 237,134 | 10/1975 | Westmoreland | D7/76 |
| D. 296,497 | 7/1988 | Kime | D3/76 |
| 513,044 | 1/1894 | Handlan, Jr. | 206/315.11 |
| 1,405,422 | 2/1922 | Kennedy | 206/373 |
| 2,457,043 | 12/1948 | Histand | 206/545 |
| 3,310,905 | 3/1967 | Davis et al. | 206/315.11 |
| 3,432,025 | 3/1969 | Luhe | 206/545 |
| 3,558,205 | 1/1971 | Mueller | 312/DIG. 33 |
| 3,926,308 | 12/1975 | Sullivan | 206/372 |
| 4,304,158 | 12/1981 | Perkins | 206/373 |
| 4,449,629 | 5/1984 | Barrieau | 206/373 |
| 4,659,154 | 4/1987 | Jenkins | 312/DIG. 33 |
| 4,768,652 | 9/1988 | Fallon | 206/373 |

*Primary Examiner*—David T. Fidei

*Attorney, Agent, or Firm*—Jennings, Carter, Thompson & Veal

[57] ABSTRACT

A portable container configured to fit behind the seat of a pickup truck utilizes an outer wedge shape to maximize the available volume. An upper and lower portion are hingedly mounted along a horizontal axis such that the upper portion may be utilized for storage, thus increasing the usable volume. A handle is provided which also serves as a support for the upper portion when in the open position. The container may be found in multiple configurations including an ice chest, a tool box, or a fishing tackle box.

9 Claims, 3 Drawing Sheets

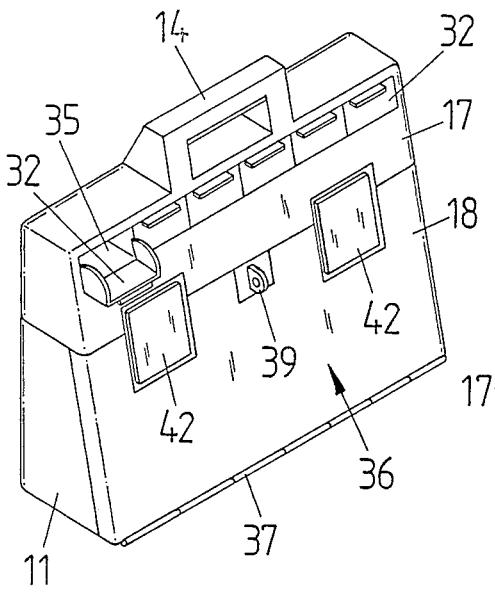
Fig. 5
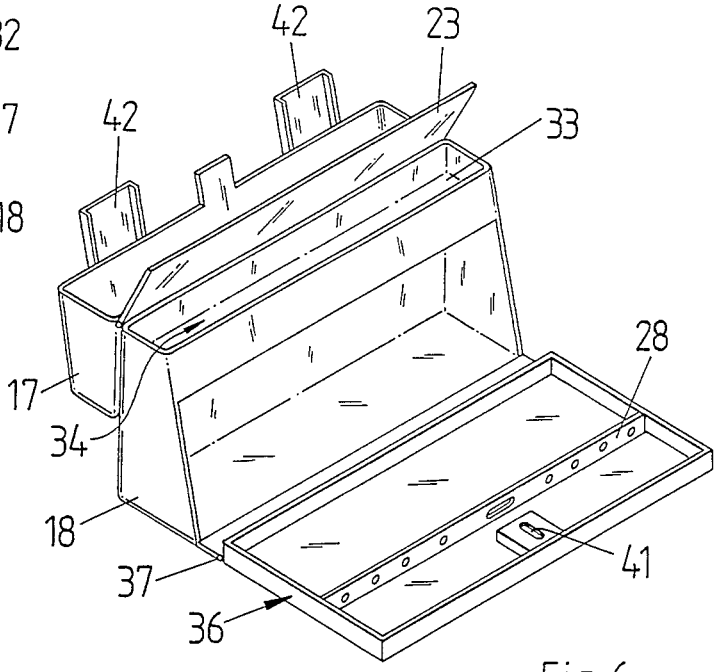
Fig. 6
Fig. 7
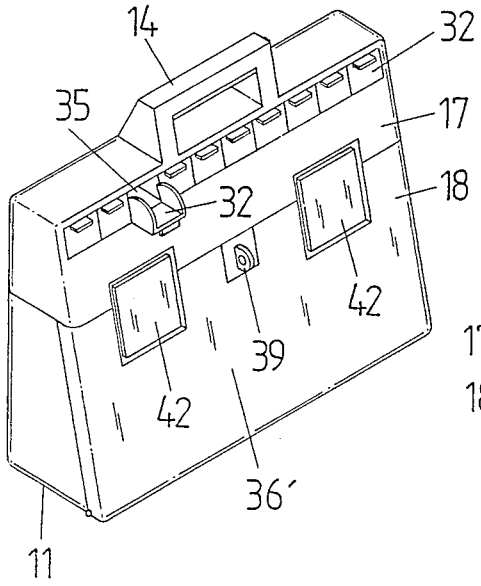
Fig. 8
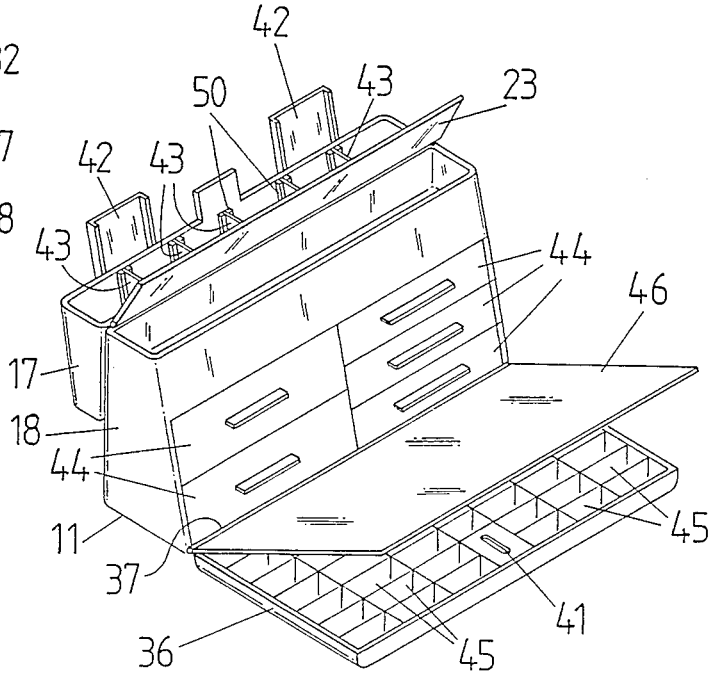

STORAGE CONTAINER

This is a continuation of application Ser. No. 115,341 filed Nov. 2, 1987.

FIELD OF THE INVENTION

The present invention relates to storage containers and more particularly to containers which are adapted to fit in unusual spaces in vehicles such as behind the seat of a pick-up truck. More particularly, the present invention relates to storage containers specifically adapted to fit behind the seats of pick-up trucks and to maximize the storage capacity of such space.

BACKGROUND OF THE INVENTION

The pick-up truck has become the personal utility vehicle for a vast number of people. Numbered in this group are the traditional pick-up drivers such as farmers and construction workers, as well as a growing number of people who use the pick-up as both a work vehicle and a recreational vehicle. At one time, the pick-up owner utilized the space behind his seat to store his jack and tire irons. Eventually, this area became the storage place for hammers, screwdrivers and all sorts of useful articles. The useful articles were not very usefully located. As increasing numbers of painters, construction personnel and other artisans began using pick-ups rather than panel trucks, a need arose for tool and equipment storage that would be somewhat organized and which could be secured. Tool boxes were fashioned to fit between the sidewalls immediately behind the cab in the bed of the truck. While such compartments have generally served the purpose of the craftsman or artisan, not everyone who wishes to store his equipment has need of such space and furthermore, it is somewhat inconvenient to return to the truck to swap tools. This problem was partially addressed by my uniquely shaped tool box disclosed in U.S. Design patent application Ser. No. D-758,429 entitled "CARRIER CASE" which is incorporated herein by reference. The "CARRIER CASE" did not completely solve the problem in that it left something to be desired in terms of its internal capacity, particularly with respect to the efficient utilization of such capacity.

SUMMARY OF THE INVENTION

It is the object of the present invention to maximize the usable storage space available in a portable storage container which may be placed behind the seat of a truck.

Another object of the invention is to provide a container as described above which is stable and self-supporting when opened.

To accomplish these objects, my invention utilizes a generally triangular shape similar to the shape of my "CARRIER CASE" of Ser. No. D-758,429. That is to say, the present invention utilizes a wedge shape which fits behind a truck seat between the back of the seat and the rear wall of the cab. In its normal upright position, the container rests on a narrow base and tapers upwardly to a top, with one side remaining vertical and the other inclined toward the vertical side. The container is hinged at its vertical midpoint such that a top and bottom portion are formed with the top including a shaped handle. When the top is opened to its full extent, the handle assists in supporting the top portion as it rests against the side of the bottom portion. In certain embodiments, the top and bottom portion may be divided into additional compartments for segregated storage of various items.

BRIEF DESCRIPTION OF THE DRAWINGS

Apparatus embodying features of my invention are depicted in the accompanying drawings which form a portion of this disclosure and wherein:

FIG. 5 is a perspective view of my invention configured as a tool box;

FIG. 6 is a perspective view of the tool box of FIG. 5 in the open position;

FIG. 7 is a perspective view of my invention configured as a fishing tackle box; and FIG. 8 is a perspective view of the tackle box of FIG. 8 shown fully opened.

DESCRIPTION OF A PREFERRED EMBODIMENT

Figure 1:
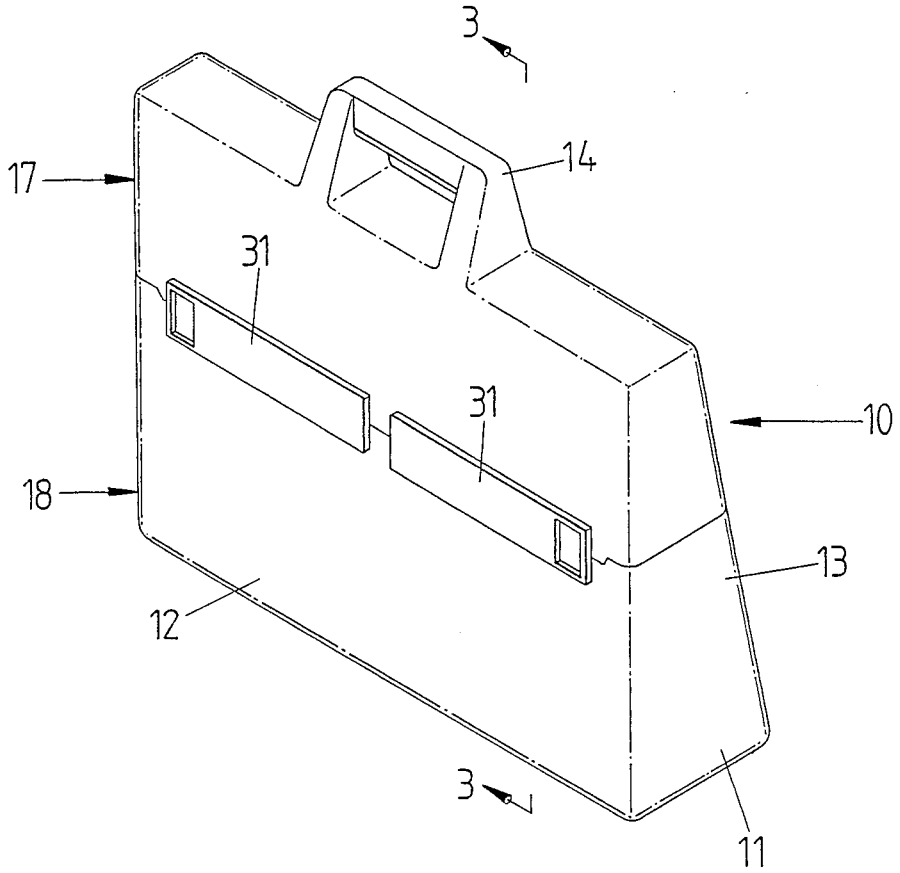
FIG. 1 is a perspective view of my invention configured as a cooler.
Figure 3:
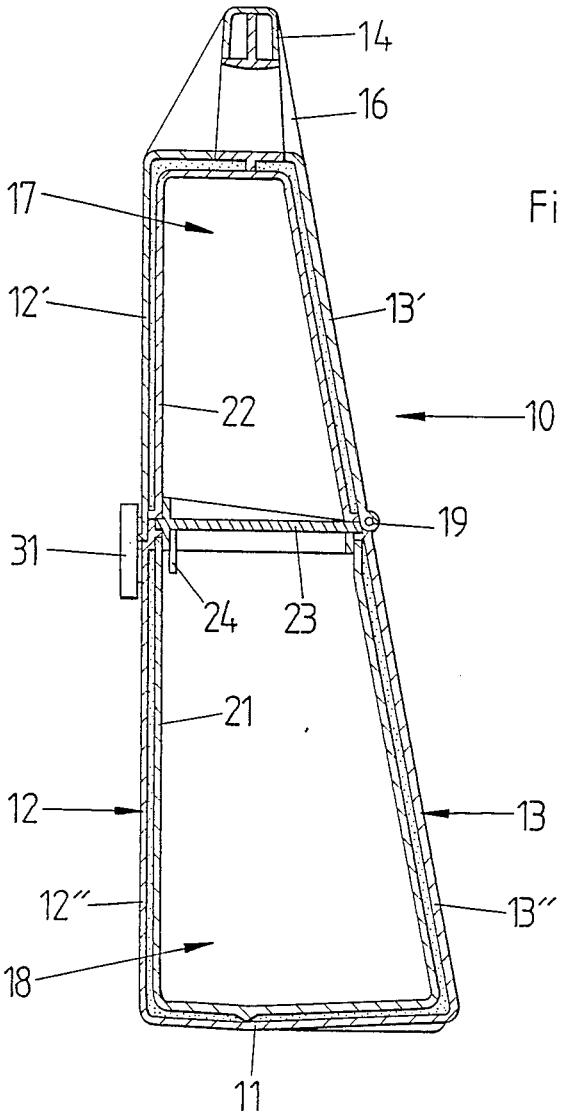
FIG. 3 is a sectional view taken along line 3—3 of FIG. 1.

Referring to the Drawings for a better understanding of the invention, it will be noted in FIGS. 1, 3, 5 and 7 that the invention comprises a container 10 having a generally wedge-shaped appearance. The container rests on a generally rectangular base 11 and has a vertical wall 12 which extends vertically from the base and an inclined wall 13 which is inclined toward the vertical wall 12. A handle 14 is provided with a portion 16 of the handle webbing serving as a continuation of inclined wall 13. The container 10 is divided into an upper portion 17 and a lower portion 18 which are jointed along a hinge 19 which bisects inclined wall 13 into an upper inclined wall 13' and lower inclined wall 13". Alternatively, as will be seen hereinafter, the hinge may bisect wall 12. The distance from hinge 19 to the top of the handle 14 is the same as the distance from the hinge 19 to the bottom of the base 11; therefore, as its illustrated in FIG. 3, the handle 14 serves to support the upper portion 17 when the container 10 is open. The handle 14 is also offset toward first wall 12 for balance at the center of gravity of the container.

Figure 2:
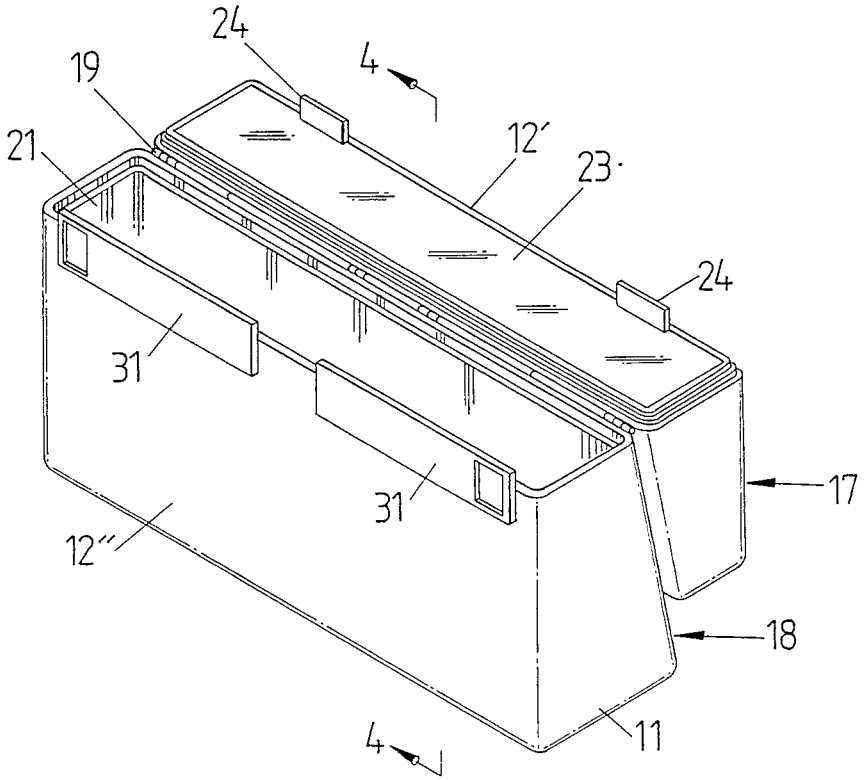
FIG. 2 is a perspective view of the cooler of FIG. 1 with the top portion open.
Figure 4:
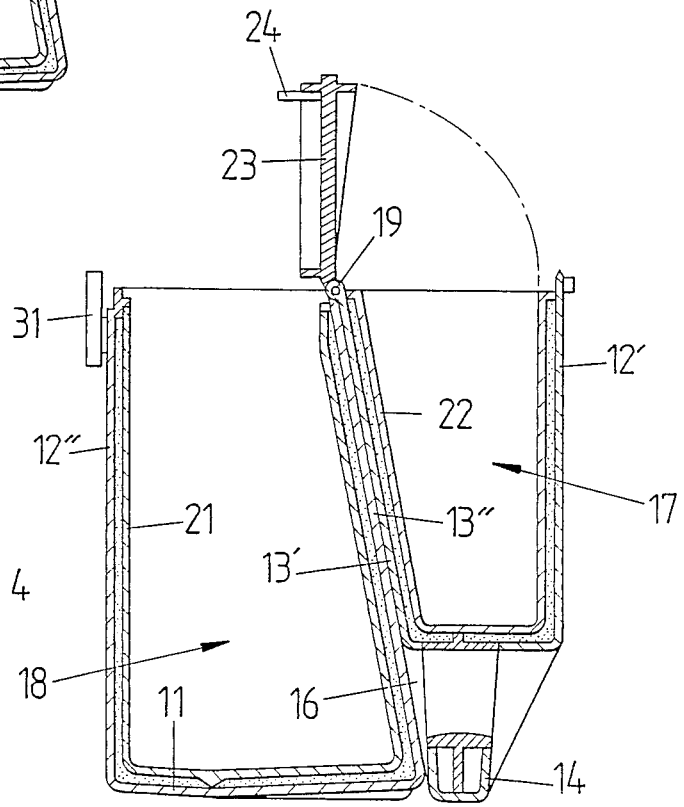
FIG. 4 is a sectional view taken along line 4—4 of FIG. 2.

The embodiment shown in FIGS. 1—4 is configured as a cooler. An internal wall or liner 21 is provided in the lower portion 18 and a similar liner 22 is provided in the upper portion 17. The space between the liners and the adjacent walls or base is foam-filled as is well known in the art to improve the insulative qualities of the container 10. Mounted for hinged movement about hinge 19 is a partition 23 which serves to close upper portion 17 and separate the contents thereof from the contents of the lower portion 18. The lower portion 18 thus provides bulk storage for ice and beverage cans while the upper portion 17 may serve as a dry storage area for food. A pull tab 24 or the like is formed in partition 23 so that the partition 23 may be moved to access the contents of the upper portion 17. It should be clear that a cooler of this design may be conveniently transported behind the seat of a truck and will keep foods such as sandwiches cooled without allowing them to contact moisture from the melted ice in the lower portion 18. The upper portion 17 and lower portion 18 may be secured for storage or for carrying using a suitable latch such as the laterally sliding latch 31 illustrated in the Figures.

A second embodiment of my invention is shown in FIGS. 5 and 6. This embodiment has the same general external appearance as previously discussed; however, it is configured as a tool box and is hinged at the midpoint of wall 12. Accordingly, the upper portion 17 has a plurality of compartments formed therein, each with a transparent door 32. Each compartment serves as a separate storage area for small parts, such as nuts, screws, or nails, which are accessible without opening the remainder of the tool box. As seen in FIG. 6, the part of the upper portion 17 which is not occupied by the compartments serves as bulk storage and can be closed with partition 23. The top of the lower portion 18 is closed by a bottom 33 and may serve as a tray 34 for storage of small articles. The remainder of the bottom portion 18 is available for bulk storage and is accessible via a door 36 which forms the lower inclined wall 13 and is hingedly mounted to the base 11 as at hinge 37. The door 36 has formed on the inside thereof a tool hanger 28 which is a strip of material attached to the door 36 and extending generally perpendicular thereto with a plurality of apertures therein for receiving tools such as screwdrivers, awls, pliers and the like such that the tools are supported on and segregated from the remaining bulk storage area.

The upper portion 17 also has formed thereon an outwardly extending eyelet 39 which passes through a slot 41 formed in door 36 to provide additional security such that the upper portion 17 bulk storage or tray 34 cannot be accessed without opening the door 36. The tool box is also provided with latches 42 which may be used to secure the upper portion 17 and lower portion 18 for storage and for carrying purposes.

Another embodiment is shown in FIGS. 7 and 8. This embodiment is suitable for use as a fishing tackle box or the like. The embodiment includes a plurality of storage compartments 35 formed in the upper portion 17 and closed by transparent doors 32. The volume of the upper portion 17 not used for such compartments 35 may be used for bulk storage or may be sectioned as with spinner bait racks 43 inserted between parallel ribs 50 formed on the interior of the upper portion 17. Spinner baits placed therein would be held in position by the interaction of the racks 43 and the partition 23. Also tray 34 is available as bulk storage or may be sectionalized. The volume of the lower portion 18 beneath the tray 34 is provided with a plurality of pull out drawers 44. In this embodiment, the lower inclined wall 13 is formed as a hinged door 36' which is made of transparent plastic and which has formed therein a plurality of inwardly opening storage compartments 45. A panel-like member 46 is hingedly mounted along hinge 37 such that the member 46 closes the storage compartments and separates them from the interior of the lower portion 18. The upper portion 17 and the door 36' interact for closure in the same manner as in the tool box embodiment. That is to say, a pair of latch members 42 as well as eyelet 39 and slot 41 are provided to secure the upper portion 17 and lower portion 18 for storage or carrying.

From the foregoing, it may be seen that my invention is subject to a plurality of adaptations and modifications to suit particular need, however, it appears that the embodiments shown herein will provide satisfactory portability and storage for most users.

While I have shown my invention in various forms, it will be obvious to those skilled in the art that it is not so limited but is susceptible of various changes and modifications without departing from the spirit thereof.

What I claim is:

1. A portable container comprising an upper and lower portion, said upper portion including a rigid handle, with said upper and lower portion forming a wedge shape trapezoid and being hingedly joined along a line bisecting the height of said container such that said upper portion and said lower portion are of equal height and provide lateral support to each other when said container is fully opened; said lower portion including a door pivotally mounted proximal the bottom thereof along a horizontal axis of said door and said upper portion being cooperatively formed to effect closure of said container; and a horizontal divider hingedly mounted at the intersection of said upper and lower portion of pivotal movement about a horizontal axis said panel separating the internal volume of said lower and upper portions.

2. A container as defined in claim 1 further comprising a plurality of compartments formed in said upper portion, each compartment having a transparent door thereto.

3. A container as defined in claim 1 wherein said door has affixed to the inner side thereof a means for supporting a plurality of hand tools.

4. A container as defined in claim 1 wherein said door comprises a clear outer portion having a plurality of compartments formed therein with each of said compartments being open on the side inwardly of said container; and a panel hingedly mounted coaxially with said clear outer portion with said panel separating said clear outer portion with the inside of said lower portion.

5. A container as defined in claim 4 further comprising a plurality of individual compartments slidably mounted within said lower portion and accessible when said door is open.

6. A container as defined in claim 1 further comprising an upwardly opening tray-like region formed in the top of said lower portion.

7. A portable container as defined in claim 1 wherein said upper portion has an eyelet formed thereon and extending outwardly therefrom and said door has a loop formed therein cooperatively positioned for receiving said eyelet therethrough.

8. A container as defined in claim 1 wherein said door comprises a clear outer portion having a plurality of compartments formed therein with each of said compartments being open on the side inwardly of said container; and a panel hingedly mounted coaxially with said clear outer portion with said panel separating said clear outer portion with the inside of said lower portion.

9. A container as defined in claim 1 wherein said upper and lower portions are divided into a plurality of compartments for storing articles therein.

* * * * *